United States Patent [19]

Gillis

[11] 4,175,305

[45] Nov. 27, 1979

[54] CLIP FOR GRIPPING FABRIC OR THE LIKE

[76] Inventor: Robert E. Gillis, P.O. Box 67, Santa Cruz, Calif. 95003

[21] Appl. No.: 825,410

[22] Filed: Aug. 17, 1977

[51] Int. Cl.[2] ..... A44B 21/00

[52] U.S. Cl. ..... 24/245 R; 24/243 K; 135/15 CF

[58] Field of Search ..... 24/72.5, 243 K, 245 R, 24/245 A, 246, 113 R, 30.5 L, 263 R; 135/15 CF

[56] References Cited

U.S. PATENT DOCUMENTS

| | | | |
|---|---|---|---|
| 464,108 | 12/1891 | Redfield | 24/245 R |
| 960,849 | 6/1910 | Dilg | 135/15 CF |
| 1,828,041 | 10/1931 | Hamacher | 24/245 R |
| 2,302,341 | 11/1942 | Nash | 24/245 R |
| 3,283,383 | 11/1966 | Heath | 24/245 R |
| 3,530,550 | 9/1970 | White | 24/245 A |
| 3,986,519 | 10/1976 | Gillis | 135/15 CF |

FOREIGN PATENT DOCUMENTS

| | | | |
|---|---|---|---|
| 548978 | 4/1932 | Fed. Rep. of Germany | 24/245 R |
| 1810129 | 7/1970 | Fed. Rep. of Germany | 24/243 K |
| 2453915 | 5/1976 | Fed. Rep. of Germany | 135/15 CF |
| 189038 | 11/1963 | Sweden | 24/245 R |

*Primary Examiner*—Bernard A. Gelak
*Attorney, Agent, or Firm*—Robert G. Slick

[57] ABSTRACT

A clip is provided which is adapted for fastening onto a flexible web such as a sheet of fabric. The clip is particularly adapted for fastening the fabric of a tent to supporting poles or stakes or for fastening webs together.

3 Claims, 12 Drawing Figures

CLIP FOR GRIPPING FABRIC OR THE LIKE

SUMMARY OF THE INVENTION

The present invention relates to a clip which can be used for fastening a ring-like member to a sheet of flexible material such as fabric. The clip was developed primarily for fastening loops, poles and stakes onto a flexible web to provide a connector suitable for use in a tent made in accordance with my U.S. Pat. No. 3,986,519. However, as will become later apparent, the invention is one of broad applicability and has many other uses.

Heretofore, it was ordinarily necessary in fastening a member on the fabric to penetrate the material in some way such as by sewing a loop onto the canvas or by piercing the canvas and placing washer-like members on each side of the canvas on a support member. Fasteners which do not penetrate the fabric ordinarily provide a weak connection which is easy to pull apart.

In accordance with the present invention, an improved fastener is provided which does not require penetration of the fabric in any manner so that the canvas is not weakened. Strain on either the fabric or the fastener actually increases the gripping power.

An object of the present invention is to provide a fastener for canvas or the like wherein the strain is distributed over a large area of the canvas so that maximum strength is attained.

Another object of the present invention is to provide a clip which is easily inserted or removed without marring the fabric so that it may be moved from one location to another without leaving any evidence of its use behind.

Another object of the present invention is to provide a clip which can be applied to fabric without the use of tools and with only simple hand pressure.

Still a further object of the invention is to provide a clip which is adapted to carry a multiplicity of attachments.

Another object is to provide a fastener which is reuseable.

A still further object of the invention is to provide a clip which is simple to attach so that it can be put on by the user rather than the tent manufacturer, thus lowering production cost.

Still another object of the invention is to provide a clip which is adapted for securing two or more sheets of a flexible material together in a positive manner.

The clip of the present invention engages the fabric or other web between (a) mating flat surfaces on the two parts of the clip which are parallel to the surface of the web and (b) between mating collar surfaces at right angles thereto so that pulling on the female element will not cause the parts to become separated.

Other objects and features of the invention will be brought out in the balance of the specification.

DESCRIPTION OF THE PREFERRED EMBODIMENTS

Figure 1:
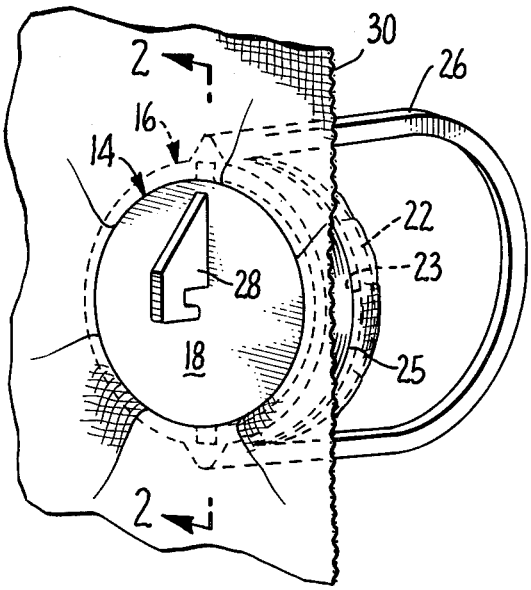
FIG. 1 is a perspective view of a clip embodying the present invention.
Figure 2:
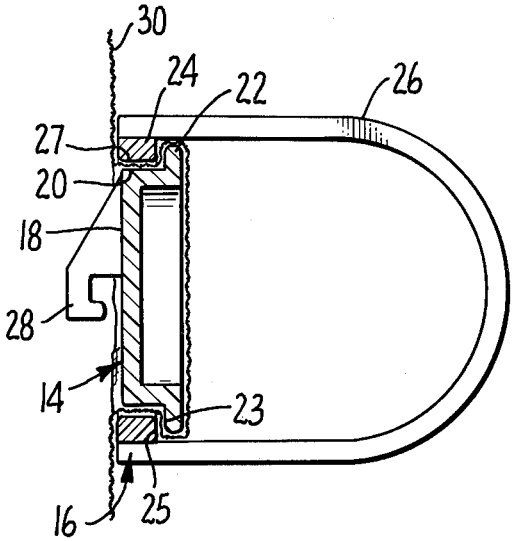
FIG. 2 is a section on the line 2—2 of FIG. 1.

Turning now to the drawings by reference characters, there is shown in FIGS. 1–4 a preferred embodiment of the invention which is provided with a loop element and is particularly adapted for use as a tent fastener in a tent constructed in accordance with my previously identified patent. In accordance with this embodiment of the invention, the male element generally designated 14 mates with a female element generally designated 16. In this embodiment of the invention, the female element must be somewhat flexible as is later explained in detail. The male element 14 has a flat plug portion 18 which terminates in cylindrical surface 20. A lip or rim 22 is formed at the outer edge of the cylindrical portion 20 and which has a flat surface 23. The female element 16 includes a collar 24 of a soft, flexible plastic and has a flat surface 25 which mates with flat surface 23 and its inner surface 27 mates with surface 20. In this embodiment of the invention, a loop 26 is formed integrally with the collar 24. The male element can also have a hook 28 formed thereon which is useful inside a tent for hanging articles or for fastening to another layer of fabric.

Figure 3:
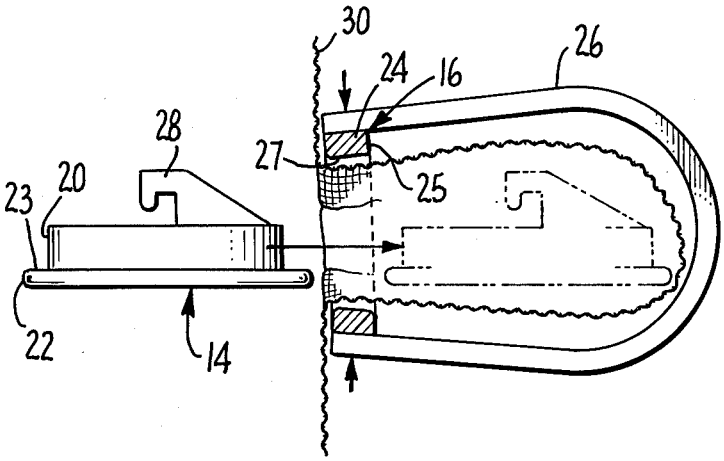
FIG. 3 is a perspective view, similar to FIG. 2, showing the motion of the parts during a first stage of assembling the clip to a piece of canvas.
Figure 4:
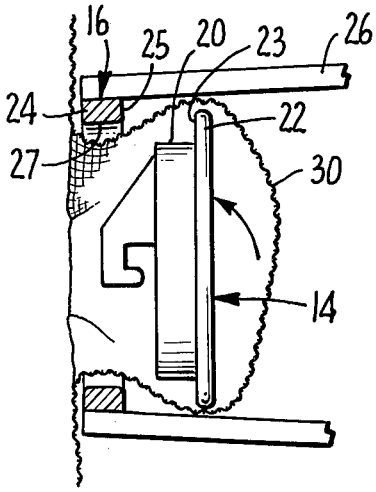
FIG. 4 is a view similar to FIG. 3 showing the position of the parts just prior to final assembly.

The method of assembly of the clip of the present invention is best seen with reference to FIGS. 3 and 4. The female element 16 is placed adjacent to a sheet, such as tent fabric 30. The ring element 24 is then compressed by finger pressure in the direction shown by arrows so that the round element 24 is distorted to an oval shape. The male element 14 is now passed through the oval shaped opening in the manner shown in FIG. 3, i.e. from the position shown in solid lines to the position shown in dot-dash lines. Now the element 14 is rotated one-quarter turn and pressure on the ring 24 released so that the parts are now in a position shown in FIG. 4. Now the male element 14 is pushed against the collar 24 so that the parts now assume the position shown in FIG. 2. The fabric 30 is engaged between the flat surfaces 23 and 25 and these surfaces are parallel to the plane of the main body of canvas 30 as well as between the surfaces 20 and 27 which are at right angles thereto, so either the female or male elements or the fabric can be pulled or twisted without disengaging the elements. It is thus apparent that the element has been snapped on to the fabric without puncturing the fabric in any manner and without seriously distorting it. Also since the gripping area is in the form of a large circle, the maximum strength of the fabric is utilized.

Figure 5:
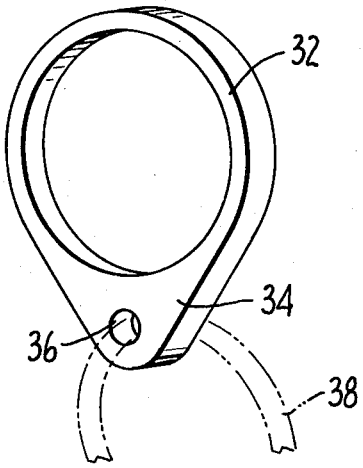
FIG. 5 is a perspective view showing how the female element may be modified to hold a loop.

In FIG. 5 another embodiment of the female element is shown wherein the female element consists of a ring-like member 32 which is enlarged at one edge as at 34 with a hole 36 in the enlarged portion. This is useful as a tent hold-down since a rope 38 can be passed through the hole 36. The hole 36 could be made larger and elongated to provide a hand grip.

Figure 6:
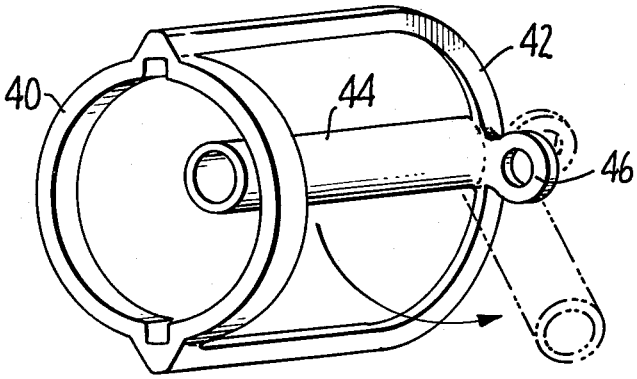
FIG. 6 is another embodiment of the female element showing an arch element having a pole holder and hold-down loop formed integrally therewith.

In FIG. 6 still another embodiment of the female element is shown wherein a ring 40 has an arch-shape loop 42 formed integrally therewith and wherein the element 42 has a hollow cylinder 44 and a loop 46 molded near the center. In assembling the element, the loop 42 has sufficient flexibility so that the parts 44 and 46 can be temporarily bent to one side for the insertion of the male element as is shown in phantom. The relationship of the parts is such that the entire female element, including the members 42, 44 and 46, can be easily molded from a single piece of plastic in a simple two piece mold. This is possible since 44 is parallel to the inside walls of 40 and the outer extremity of 46 lies within an imaginary extension of the inside walls of 40. This emnodiment serves both as a pole holder and a tie down at the edge of a tent and the pole holder can be bent to a desired angle.

Figure 7:
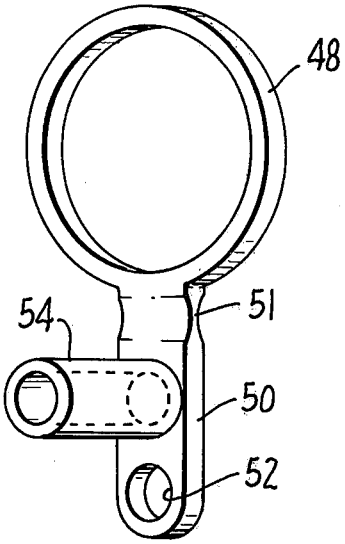
FIG. 7 is a perspective view of another embodiment of the female element showing a pole holder and loop formed on the element proper.

In FIG. 7 still another embodiment of the female element is shown wherein a ring 48 has an extension 50 molded on one side thereof which has a hole 52 at the terminal end and a hollow cylinder 54 between the ring and the hole. Extension 50 preferably has a thin cross section at 51 so the pole holding the cylinder can be bent to a desired angle. This female element is particularly advantageous for use around the edges of a tent having arch-shaped poles since the terminal ends of the poles can be placed in the cylinder 54 and the hole 52 used for a tie-down rope. More than one cylinder can be formed on the extension 50, or more than one extension can be formed on the ring 48, so that two or more poles can be fastened. Slot 66 permits the element to be molded in a simple mold. The loop 68 has sufficient flexibility so that the parts can be assembled in the same manner as in FIGS. 3 and 4.

Figure 8:
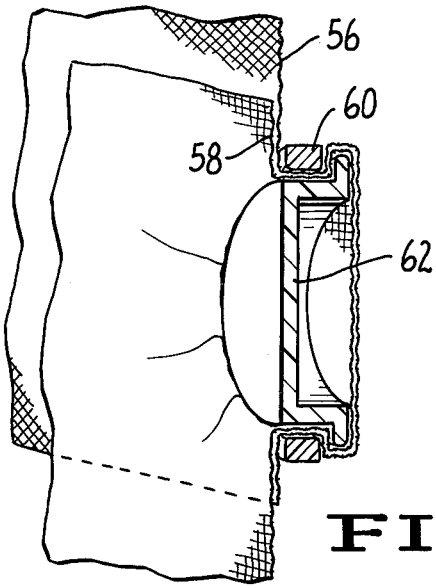
FIG. 8 is a sectional view showing how the clip of the present invention can be employed to lock a plurality of sheets together.

In some instances, one merely wishes to fasten two or more sheets together, in which case it is not necessary to provide either the male or female elements with loops or similar attachments. This utilization of the invention is shown in FIG. 8 wherein a first sheet of fabric 56 is fastened to a second sheet 58. The female element 60 and the male element 62 are merely used to hold the two sheets together. The two sheets are firmly attached yet can be detached at any time.

Figure 9:
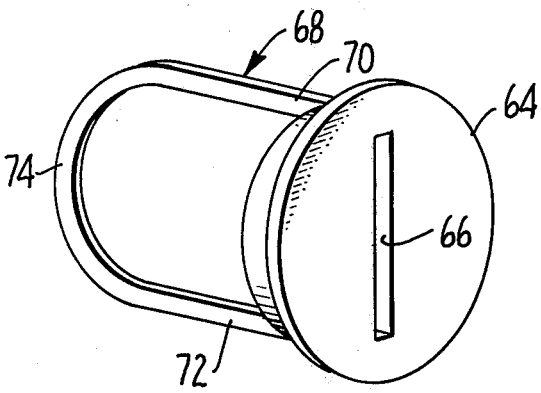
FIG. 9 is a perspective view showing a loop formed on the male element.

In some instances, it is desired to provide the male element with a large loop in which case the structure shown in FIG. 9 can be employed. Here the male element 64 is provided with a U-shaped member generally designated 68 which has straight side members 70 and 72 connected by the central arch 74.

In the embodiments of the invention heretofore described, at least the female element must be molded of a relatively soft, yieldable plastic such as polypropylene. Since the male element is not subjected to any distortion, it can be made of a hard plastic or even metal but preferably both parts of the fastener are molded from a yieldable plastic.

Figure 10:
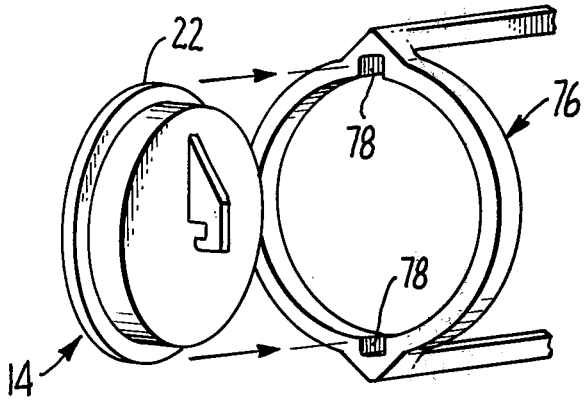
FIG. 10 is a perspective view showing a modified female element wherein it is not necessary to flex the female element in order to assemble the parts.
Figure 11:
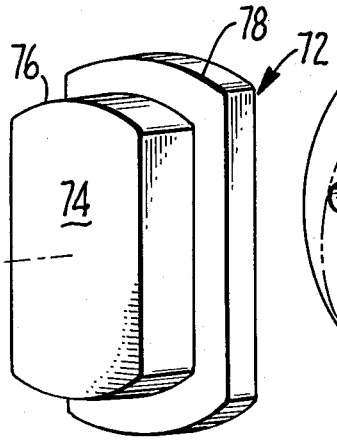
FIG. 11 is a perspective view of another embodiment of the invention.
Figure 11:
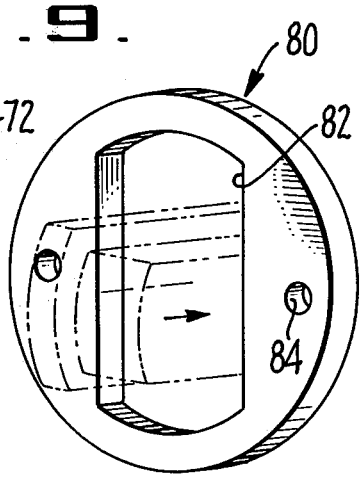
Figure 12:
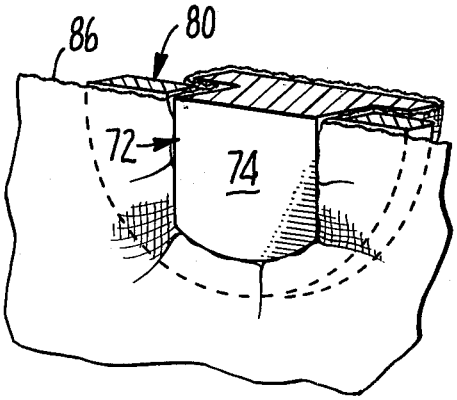
FIG. 12 is an enlarged perspective view, partly in section, of the embodiment of FIG. 11.

In FIGS. 10, 11 and 12 other embodiments of the invention is shown where neither element is subjected to any distortion so that both parts of the fastener can be made of a hard plastic or even metal.

In accordance with the embodiment of FIG. 10 the female element 76 is formed with two slots 78 which are directly opposed to each other. The male element 14 is as previously described and as can be seen in the drawings the rim 22 can be passed through slots 78 to assemble the fastener.

In accordance with the embodiment shown in FIGS. 11 and 12, the male element, generally designated 72, has a plug or cylinder portion 74 of generally rectangular configuration, and preferably has rounded ends 76. A rim 78 is provided which may have the same rectangular configuration. The female element, generally designated 80, has a slot 82 which is complementary to the plug 74. The member 80 may be provided with one or more holes 84 or other fastening means as heretofore described. In this embodiment of the invention, the female element is not distorted in any manner but the element 72 is merely turned sideways as is shown in phantom in FIG. 11 for insertion through the female element. After insertion, it is turned back so that the plug 74 lies in the slot 82 with one or more sheets of canvas 86 gripped between the male element 72 and the female element 80, holding a sheet of canvas 86 therebetween as is shown in FIG. 12.

Although certain specific embodiments of the invention have been shown, it is obvious that the invention is one of broad applicability and that the male and female elements may take different forms. Further, the elements have been described primarily for use as tent fasteners but it is obvious that they may be used as fasteners for any flexible sheet such as fabric, plastic, or even tough paper such as parchment paper.

I claim:

1. A fastener for attachment to a web of flexible material comprising in combination:

a. female element comprising a collar having a side wall formed as a hollow cylinder and a flat out-turned rim surface surrounding said side wall at a right angle to said cylinder, b. a male element having a plug portion having an external cylindrical wall and an out-turned rim extending around said plug, said external cylindrical wall being complementary to said hollow cylinder and said out-turned rim having a flat surface adapted to lie against the flat out-turned rim surface of the female element, c. whereby said female element can be placed against said web on a first side of the web and said male element can be placed on the opposite side of the web and pushed through said female element, distorting said web, and brought back to lie substantially against the female element with the web engaged (1) between the flat surfaces of the two out-turned rims, and (2) between the side wall of the hollow cylinder and the external cylindrical wall of the male element wherein the flat surfaces of the web held between the two out-turned rims is parallel to the main portion of the web, d. wherein said female element has a loop bridging opposite sides of the collar.

2. The structure of claim 1 wherein said center is round and said collar is flexible whereby said collar can be distorted by pressure on opposite sides to form an elongated oval to permit said plug to pass therethrough.

3. The structure of claim 1 wherein said loop has at least one hollow cylinder formed integrally with the center of said loop, said cylinder being in line with said hollow center.

* * * * *